US010036996B2

(12) United States Patent
Koketsu et al.

(10) Patent No.: US 10,036,996 B2
(45) Date of Patent: Jul. 31, 2018

(54) SLIDING MEMBER, SLIDING DEVICE INCLUDING SLIDING MEMBER, AND ELECTROPHOTOGRAPHIC IMAGE FORMING APPARATUS INCLUDING SLIDING DEVICE

(71) Applicant: CANON KABUSHIKI KAISHA, Tokyo (JP)

(72) Inventors: Naoyuki Koketsu, Komae (JP); Tetsuo Hino, Yamato (JP); Kenji Takashima, Numazu (JP); Akiko Takei, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 164 days.

(21) Appl. No.: 15/052,643

(22) Filed: Feb. 24, 2016

(65) Prior Publication Data

US 2016/0252876 A1 Sep. 1, 2016

(30) Foreign Application Priority Data

Feb. 27, 2015 (JP) ..... 2015-039401

(51) Int. Cl.

| | |
|---|---|
| ***B05D 3/00*** | (2006.01) |
| ***G03G 21/16*** | (2006.01) |
| ***G03G 15/16*** | (2006.01) |
| *G03G 15/22* | (2006.01) |

(52) U.S. Cl.
CPC ..... *G03G 21/1695* (2013.01); *G03G 15/1615* (2013.01); *G03G 15/224* (2013.01)

(58) Field of Classification Search
None
See application file for complete search history.

(56) References Cited

U.S. PATENT DOCUMENTS

| | | | | |
|---|---|---|---|---|
| 5,776,600 | A * | 7/1998 | Katayama | C04B 35/01 384/467 |
| 8,518,543 | B2 * | 8/2013 | Kano | C23C 16/0281 427/249.1 |
| 2006/0263604 | A1 * | 11/2006 | Martin | C10M 129/00 428/408 |
| 2007/0292711 | A1 * | 12/2007 | Ueno | C23C 16/26 428/688 |
| 2012/0177915 | A1 * | 7/2012 | Kasai | C10M 141/10 428/336 |
| 2013/0058640 | A1 * | 3/2013 | Taki | C23C 14/0605 396/531 |

FOREIGN PATENT DOCUMENTS

| | | |
|---|---|---|
| JP | 2013053340 A | 3/2013 |

* cited by examiner

*Primary Examiner* — John J Figueroa
(74) *Attorney, Agent, or Firm* — Canon U.S.A., Inc. IP Division

(57) ABSTRACT

To provide, between separated first sliding surfaces (DLC), a material of which frictional coefficient is higher than that of DLC at a temperature of 25° C. and a humidity of 45% as a second sliding surface.

19 Claims, 4 Drawing Sheets

SLIDING MEMBER, SLIDING DEVICE INCLUDING SLIDING MEMBER, AND ELECTROPHOTOGRAPHIC IMAGE FORMING APPARATUS INCLUDING SLIDING DEVICE

BACKGROUND OF THE INVENTION

Field of the Invention

The present invention relates to a sliding member including diamond like carbon (DLC) on a sliding surface thereof, and a sliding device including the sliding member.

Description of the Related Art

Materials of low friction that are self-lubricating without using oils or greases are known. Among these, DLC, which is a hard material, does not damage a sliding counterpart.

DLC is amorphous carbon having a diamond structure (sp3 mixture) and a graphite structure (sp2 mixture) mixed therein. DLC is a material having characteristics of highly hard diamond and characteristics of low-shearing graphite.

Japanese Patent Laid-Open No. 2013-53340 discloses segmenting DLC film and forming the segmented DLC film on a substrate to increase wear-resistance of a frictional contact surface.

Adhesiveness between DLC and the substrate is low. Japanese Patent Laid-Open No. 2013-53340 is proposed to increase wear-resistance on the frictional contact surface. If DLC is segmented, the DLC segments are arranged with spaces therebetween. Therefore, planar pressure between DLC and a sliding counterpart in contact with DLC is higher than that when DLC is not segmented. If the DLC segments are arranged with spaces therebetween, DLC is easily worn out or easily removed from the substrate.

SUMMARY OF THE INVENTION

The present invention provides a sliding member with reduced planar pressure on DLC of a sliding surface even if DLC is provided on the sliding surface as the sliding member.

The present invention provides a sliding member provided with a sliding surface, wherein the sliding surface has a first sliding surface and a second sliding surface, the first sliding surface comprises diamond like carbon, the second sliding surface comprises a material of which frictional coefficient is higher than that of the diamond like carbon at a temperature of 25° C. and a humidity of 45%, and the frictional coefficient of the sliding member is 0.12 or less.

The present invention provides a sliding member in which, even if the DLC segments are separated on the sliding surface, not only DLC but another member are not removed from the substrate by providing another member between the separated DLC segments while keeping the low friction property of the sliding member.

Further features of the present invention will become apparent from the following description of exemplary embodiments with reference to the attached drawings.

DESCRIPTION OF THE EMBODIMENTS

First Embodiment

A first embodiment according to the present invention relates to a sliding member in which the first sliding surface is made of diamond like carbon and, the second sliding surface is made of a material of which frictional coefficient is higher than that of diamond like carbon at a temperature of 25° C. and a humidity of 45%.

The sliding member has a first sliding surface and a second sliding surface.

The second sliding surface is disposed on a substrate in a region where the first sliding surface is not disposed.

Sliding herein refers to a relative movement between two members in contact with each other. In the present embodiment, the sliding member performs both a sliding movement in which the sliding member itself moves, and a sliding movement in which the sliding movement itself does not move but the sliding counterpart moves (that is, a sliding movement in sliding contact with the sliding counterpart).

Figure 1A:
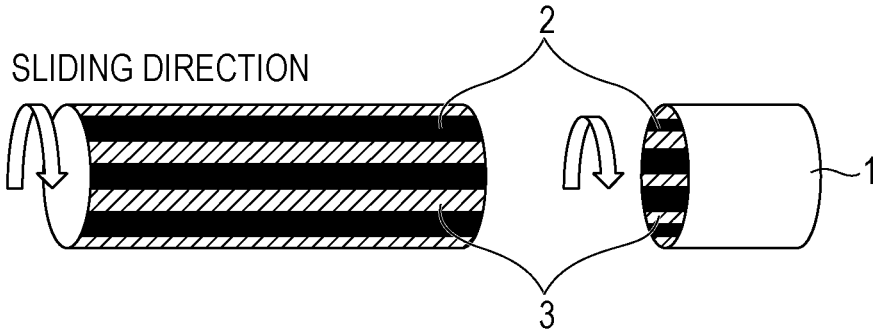
FIGS. 1A and 1B are schematic diagrams of a sliding member according to a first embodiment.
Figure 1B:
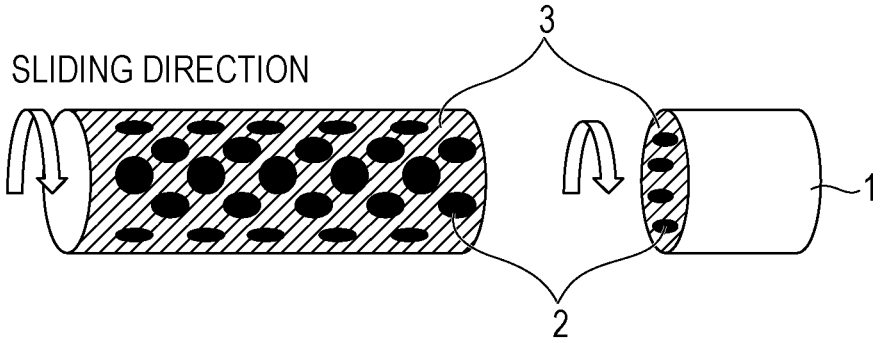

FIGS. 1A and 1B are schematic diagrams of the sliding member according to the present embodiment. FIG. 1A illustrates a state where DLC segments are arranged in a stripe pattern on a cylindrical column-shaped sliding surface (see the left-hand diagram) and a cylindrical sliding surface (see the right-hand diagram). FIG. 1B illustrates a state where the DLC segments are arranged in a dot pattern. These show that the sliding member has a plurality of first sliding surfaces.

In the first embodiment, a plurality of first sliding surfaces exist and a second sliding surface is disposed in a region where the first sliding surfaces are separated from one another.

In the left-hand diagram of FIG. 1A, the substrate is cylindrical column in shape. The first sliding surfaces 2, made of DLC, and the second sliding surface 3 are arranged on a cylindrical surface which is an outer surface. A mutually separated plurality of first sliding surfaces are arranged in a stripe pattern. The second sliding surface 3 is disposed between the mutually separated first sliding surfaces, and a material included in the second sliding surfaces 3 is in contact with DLC. The sliding member rotates as illustrated in FIGS. 1A and 1B and slides in contact with the sliding counterpart (not illustrated).

In the right-hand diagram of FIG. 1A, the substrate is cylindrical in shape. The first sliding surfaces 2 and the second sliding surface 3 are provided on an inner surface of a cylindrical substrate 1. Other configurations are the same as those of the left-hand diagram of FIG. 1A. The sliding member rotates as illustrated in FIGS. 1A and 1B and slides in contact with the sliding counterpart (not illustrated).

In FIG. 1B, the DLC segments are arranged in a dot pattern and, except for that, both the left-hand and the right-hand diagrams are the same as those of FIG. 1A.

The member included in the second sliding surface has a frictional coefficient that is higher than that of DLC. For example, the frictional coefficient of DLC included in the first sliding surfaces is equal to or greater than 0.12 to equal to or lower than 0.20.

The frictional coefficient is a value at a temperature of 25° C. and a humidity of 45%. For example, the frictional coefficient may be measured by applying a probe to a surface of the sliding member illustrated in FIGS. 1A and 1B. In this case, the frictional coefficient when the probe passes only through the first sliding surfaces may be referred to as a frictional coefficient of the first sliding surfaces, and the frictional coefficient when the probe passes only through the second sliding surface may be referred to as a frictional coefficient of the second sliding surface. The frictional coefficient of the second sliding surface is equal to or greater than 0.12 to equal to or lower than 0.30.

The frictional coefficient of each sliding surface may be calculated in the following manner. At a temperature of 25° C. and a humidity of 45%, a probe with a ball of 10 mmΦ made of SUS304 fixed at the tip thereof is moved at a rate of 600 mm/min in contact with each of the sliding surfaces with the load N of 100 g. Resistance F at this time is monitored and the frictional coefficient μ may be obtained based on F=μN.

The frictional coefficient of the sliding member according to the present embodiment is 0.12 or lower at a temperature of 25° C. and a humidity of 45% and may be calculated by, for example, the following method.

The sliding counterpart is prepared as a rotary member and the torque is measured by pressing the sliding member against the sliding counterpart so that load is applied thereto. The load to be applied is measured simultaneously in a load cell. Resistance of the sliding member is obtained from the measured torque and the diameter of the shaft, and the frictional coefficient μ is calculated from Expression F=μN based on the load measured by the load cell.

The shape and existence of the first sliding surfaces or the second sliding surface may be confirmed by observing the sliding surfaces of the sliding member with an optical microscope, a laser microscope, and a scanning electron microscope (SEM).

As described above, in the sliding member according to the present embodiment, since the second sliding surface is disposed in the region on the substrate where the first sliding surfaces are not provided, DLC is not removed from the substrate even if the entire surface of the substrate is not covered with DLC. Further, even if the material included in the second sliding surface has a frictional coefficient higher than that of DLC, the frictional coefficient of the sliding member is 0.12 or less, which means that the sliding member keeps its low friction property.

Further, if a plurality of first sliding surfaces are provided, and a second sliding surface is provided in a region in which the first sliding surfaces are separated, since the material of the second sliding surface is disposed in contact with DLC, removal of DLC from the substrate may be controlled more reliably.

A ratio of the first sliding surfaces and the second sliding surface may be suitably determined so as not to cause removal of DLC from the substrate. For example, the ratio of the first sliding surfaces is desirably equal to or greater than 20% to equal to or less than 90% of the entire area of the sliding surface. More desirably, the first sliding surfaces are distributed uniformly on the entire sliding surface as a plurality of regions.

Regarding a separation distance (pitch interval) of adjacent first sliding surfaces, it is only necessary to consider the separation distance from a contact area between the sliding counterpart and the sliding member, and an amount of deformation of the sliding member not to cause the deformation of the sliding member during sliding and not to cause the removal of DLC. For example, the pitch interval is equal to or greater than 1 μm to equal to or smaller than 1 mm, the upper limit is 1 mm or less, and more preferably 500 μm or less. If the sliding surface has a periodical shape, the pitch means the period.

The thickness of DLC of the first sliding surfaces is, for example, equal to or greater than 0.1 μm to equal to or less than 10 μm.

More preferably, the thickness is equal to or greater than 0.5 μm to equal to or less than 5 μm. The roughness (unevenness) of the substrate is desirably smaller than the thickness of DLC.

The separation distance between the adjacent first sliding surfaces is desirably inside the contact surface of the sliding member with the sliding counterpart. This is because the first sliding surfaces and the second sliding surface exist inside the contact surface.

The material included in the second sliding surface is a self-lubricating material. For example, at least one of MoS2, WS2, and BN which are known as solid lubricants may be used. At least one of resins, such as PTFE, polyacetal (POM), polyethylene (PE), and polyphenylenesulfide (PPS) may also be used. Therefore, the material included in the second sliding surface includes, for example, at least one of MoS2, WS2, BN, PTFE, POM, PE, and PPS.

The material included in the second sliding surface may be disposed with no space left or disposed as grains when disposed between a plurality of first sliding surfaces. The latter is more desirable. It is considered that, if the material included in the second sliding surface is disposed as grains, the material may easily enter the roughness in the thickness direction of DLC (for example, 1/10 or less of the size of the second sliding surface, i.e., the separation distance between adjacent first sliding surfaces), and may follow the deformation (film deformation) of the entire sliding member.

As will be described as an unexpected effect in Example, the sliding member according to the present embodiment has a frictional coefficient lower than that of a sliding member of which entire sliding surface is formed by DLC. This is significant when the second sliding surface is formed by at least one of MoS2 and WS2. Although details are unknown, it is considered that these materials are lamellar crystals, and a conforming layer is easily formed when DLC-derived graphite and the lamellar crystals slide against each other.

DLC is disposed directly on the substrate. The substrate may be formed by any materials. Examples of materials used in the known DLC manufacturing process may include metals, such as SUS, aluminum, copper, nickel, tungsten, chromium, titanium, gold, silver, and platinum. Engineering plastics, such as polyetheretherketone (PEEK) may also be used. If engineering plastics are used, DLC may be formed by a low temperature process.

In the sliding member, another substrate may be provided on the side opposite to the side on which DLC is disposed.

DLC may be provided on the substrate by, for example, plasma CVD, ionization vapor deposition, arc ion plating, and sputtering. The sliding surface of arbitrary pattern or arbitrary shape may be obtained by using a mask or by etching.

The material included in the second sliding surface may be disposed on the substrate by coating or by printing. Alternatively, the material may be embedded between the first sliding surfaces using a roller (roller burnishing), or surface-formation of DLC may be conducted after the first sliding surfaces and the space formed between the first sliding surfaces are coated uniformly with a granular material. Alternatively, after forming the second sliding surfaces, the first sliding surfaces may be formed between adjacent second sliding surfaces.

In disposing a material included in the second sliding surface, a granular material may be used. A granular material may be included in, for example, resin which may be coated by drying at a normal temperature, curing at a normal temperature, thermally setting, and other methods.

The sliding member according to the present embodiment which is cylindrical column or cylindrical in shape may be obtained by rolling up, together with the substrate, the flat, i.e., sheet-shaped sliding member having the first sliding surfaces and the second sliding surface.

In the foregoing description, the DLC segments are disposed in the dot pattern in the sliding member according to the present embodiment. The shape of the dot may be round, rectangular, rhombus, polygon, or a plurality of these shapes may be selected.

Second Embodiment

A sliding member according to a second embodiment of the present invention relates to a sliding member provided with a flat substrate and a sliding surface which is also flat. Other configurations are the same as those of the first embodiment.

Figure 2A:
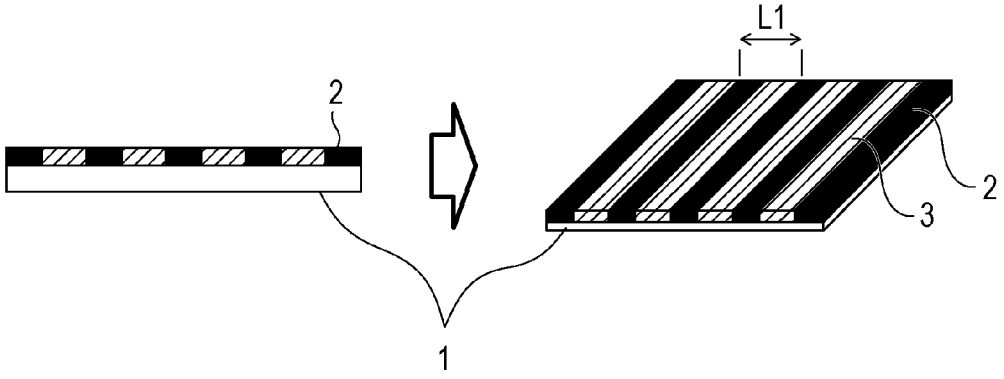
FIGS. 2A and 2B are schematic diagrams of a sliding member according to a second embodiment.
Figure 2B:
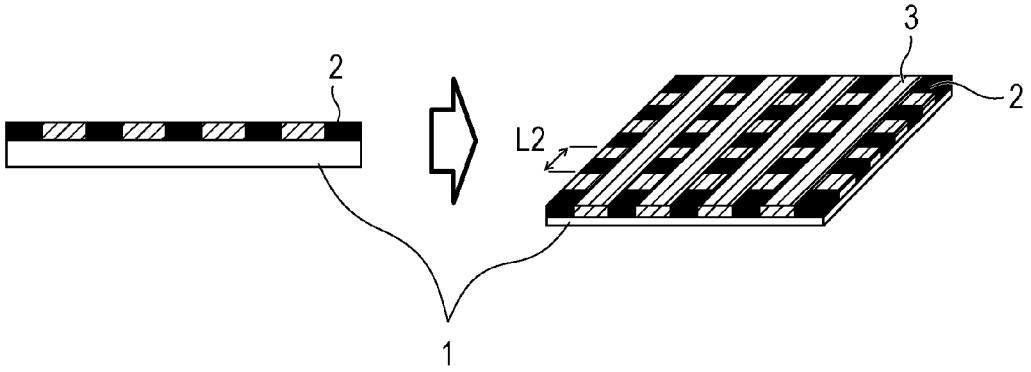

FIGS. 2A and 2B are schematic diagrams of the sliding member according to the second embodiment. The left-hand diagrams of FIGS. 2A and 2B are schematic diagrams of the flat sliding member. In the right-hand diagram of FIG. 2A, first sliding surfaces 2 are arranged in a stripe pattern. In the right-hand diagram of FIG. 2B, the first sliding surfaces 2 are arranged in a rectangular dot pattern. As illustrated in FIGS. 2A and 2B, the pitches of the first sliding surfaces are L1 and L2, respectively.

In the case of FIG. 2A, the sliding direction crosses the direction of the stripes. More preferably, the sliding direction perpendicularly crosses the direction of the stripes. The configuration illustrated in FIG. 1A is formed by rolling up (deforming) the configuration of FIG. 2A, in which a plurality of first sliding surfaces are segmented in a deformation direction, whereby concentration of stress accompanying the deformation and removal of DLC may be controlled.

Third Embodiment

A sliding member according to a third embodiment slides relatively against a sliding counterpart by reciprocating or rotating. Other configurations are the same as those of the first and the second embodiments.

The sliding counterpart may be made of, for example, SUS, SUJ2, and a member of which sliding surface is nickel-plated. The sliding counterpart may be a rod, such as a shaft, a plate, or a sphere.

The sliding member moves relative to the sliding counterpart while being in contact with the sliding body on a sliding surface. The relative movement refers to the movement of at least one of the sliding member and the sliding counterpart. The movement is, for example, reciprocation or rotation. Rotation may be conducted in, for example, the sliding surface, or may be conducted as illustrated in FIGS. 1A and 1B when at least one of the sliding member and the sliding counterpart is a rod or a cylinder.

The present invention is used desirably in a case where, for example, a cylindrical sliding member as illustrated in the right-hand diagrams of FIGS. 1A and 1B slides against a rod-shaped sliding counterpart disposed in the cylinder.

At least one of the sliding member and the sliding counterpart may be provided with a driving unit which causes a sliding movement (for example, at least one of reciprocation and rotation. The sliding member may be driven by the driving unit. Alternatively, a sliding device may have the sliding member, the sliding counterpart, and the driving unit which drives at least one of the sliding member and the sliding counterpart.

Figure 4:
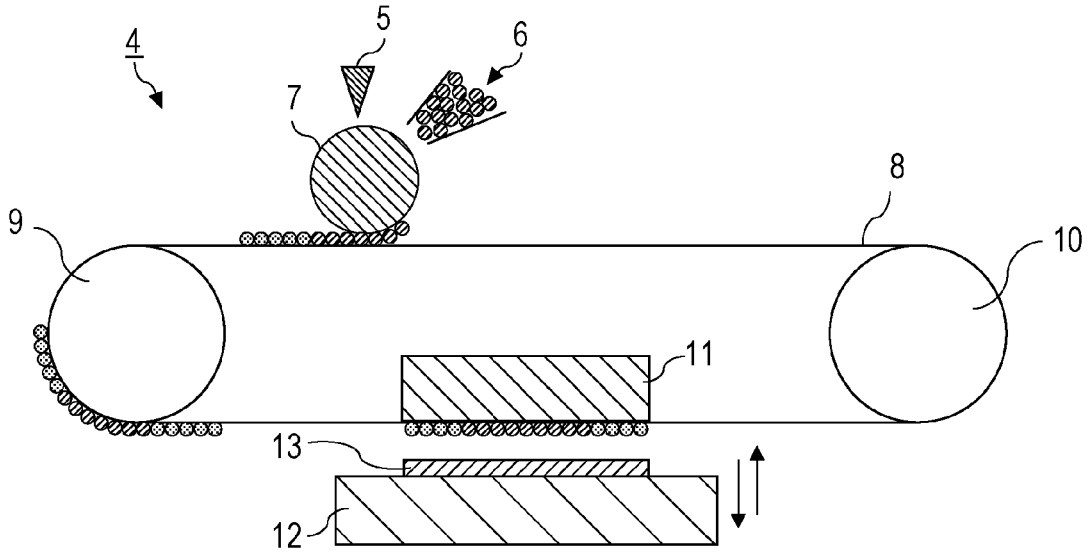
FIG. 4 is a diagram illustrating an exemplary conveying device of the present invention.

The sliding device may be provided in an electrophotographic image forming apparatus. The sliding device may be disposed at a conveyance unit which conveys a recording medium, such as paper, on which an image is recorded. If load is applied to a roller rotating in the conveyance unit, removal of DLC is controllable with low friction and the recording medium may be conveyed smoothly by employing the sliding device of the present invention. The sliding device of the present embodiment is applicable to an apparatus provided with a conveying mechanism, such as a 2D printer and a 3D printer. As an example, a configuration of an electrophotographic 3D printer 4 is schematically illustrated in FIG. 4. The 3D printer 4 of the present embodiment is used to form a 3D model by the following process. First, an intermediate transfer drum 7 is irradiated with light of laser 5 and a sliced image of the model is formed as a latent image on the intermediate transfer drum 7. A modeling material is supplied to the transfer drum 7 from a container 6 containing the modeling material, and the sliced image of the modeling material is formed on the transfer drum 7. The formed sliced image is transferred to a conveying belt 8 from the transfer drum 7 and then conveyed to a work holder 12 upon rotation of conveyance rollers 9 and 10. The sliced image of the modeling material is heat-fused, via the conveying belt 8, on an intermediate laminated product 13 by a heat-press unit 11. The 3D model is formed by laminating the intermediate laminated products 13 successively. The conveying mechanism of the sliced image has the conveyance rollers (9, 10) and the conveying belt 8. The sliding device of the present invention is applicable to bearings of the conveyance rollers (9, 10). The conveying device of the present embodiment is applicable also to mechanisms for conveying articles upon rotation of the shaft of the sliding device, and applicable also to a bearing of the intermediate transfer drum 7, bearings of other roller members, and a conveying device which conveys an article, e.g., a paper medium, such as a 2D printer. Since the sliding device of the present invention can be rotated with low friction at locations to which load is applied locally, both energy saving and noise reduction can be attained. The sliding device may also be installed in an image driving unit for development and transfer. Moreover, the sliding device may be used at any locations where friction is produced due to sliding. With the sliding device, heat generation of due to heat can be controlled and energy loss can be reduced. The present invention can be used with no need of oil or grease. Therefore, an influence to other mechanisms by oil splash can be prevented. Mechanisms to prevent oil leakage and oil splash are unnecessary. Further, a mechanism to store oil is unnecessary, either.

EXAMPLES

Evaluation on Friction in Sliding Portions

The frictional coefficient is measured with a friction measuring apparatus designed by CANON KABUSHIKI KAISHA. A shaft of SUS303 as a rotary member is rotated at a constant rotational speed by a motor. A member on which a solid lubricating film made in Example is formed is pressed against the shaft so that certain specific load is applied. Then, the torque is measured. Since load is applied, a contact portion is not linear but planar in shape. The load to be applied is measured simultaneously in a load cell. The frictional coefficient is calculated from the measured torque, the diameter of the shaft, the rotational speed, and the load.

The measurement conditions are as follows:

Material of shaft: SUS303
Rotational speed of shaft: 100 rpm
Diameter of shaft: 14 mm
Load: 20N
Atmosphere: atmospheric air
Temperature: room temperature
Contact length between sliding portion and shaft: 5 mm Example 1

DLC segments are formed on a flat SUS 440 substrate. The segment is 200-μm square. DLC is formed to the thickness of 1 μm by CVD using a mask with a gap of 50 μm. Then, WS2 (Tungmic B: manufactured by Japanese Lubricant Corporation) of an average particle diameter of 0.2 m is coated to the gap, and the entire surface is pressurized to cause WS2 to be held in the gap. WS2 on DLC is removed with a squeegee. It is confirmed with a laser microscope that WS2 is disposed between a plurality of surfaces (DLC) and a plurality of surfaces.

Comparative Example 1

DLC is formed on the entire surface of a substrate made of SUS440. Other procedures are the same as those of Example 1.

Comparative Example 2

Segmented DLC is formed on a substrate made of SUS440 in the same manner as in Example 1. The segmented DLC is 200-μm square. The segments are arranged at intervals of 50 μm with nothing formed therebetween.

Comparative Example 3

Only WS2 is provided on a substrate made of SUS440. A substrate with roughened surface of SUS440 is used and WS2 is pressurized against the substrate so that WS2 is held thereon.

Figure 3:
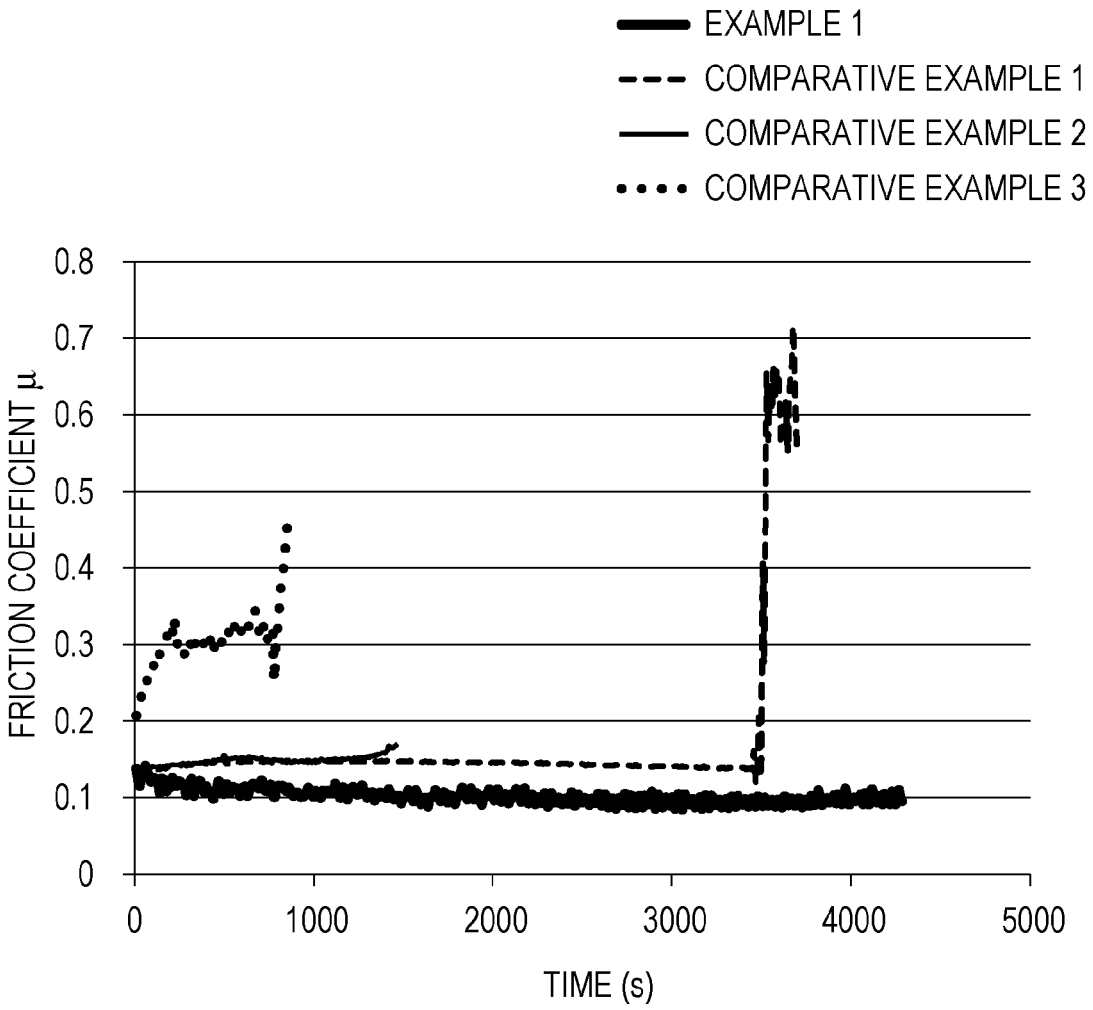
FIG. 3 is a graph illustrating a temporal change in frictional coefficients of Example and Comparative Examples.

Results of evaluation on friction in the sliding portions of Example 1 and Comparative Examples 1 to 3 are shown in FIG. 3. FIG. 3 is a graph in which changes in the frictional coefficients are plotted relative to the sliding time. The frictional coefficients are substantially the same in Comparative Examples 1 and 2, which means that pattern formation of DLC does not change the frictional coefficient.

In Comparative Example 1, the frictional coefficient increases rapidly in a range between 3000 seconds and 4000 seconds. This is because the film has been removed.

In Comparative Example 2, time until the frictional coefficient increases (in the middle of 1000 seconds and 2000 seconds) is short. This is because the film has been worn out.

The frictional coefficient in Example 1 is lower than those in Comparative Examples 1 and 2 by 30%, which means that sliding portion of Example 1 can be slid for a longer time than those of Comparative Examples 1 and 2.

The frictional coefficient in Comparative Example 3 is originally high, and the film is worn out before 1000 seconds.

Surprisingly, although Example 1 has a member of which frictional coefficient is higher than that of DLC on the sliding surface, the frictional coefficient on the sliding surface is lower than that of Comparative Example 1 in which only DLC is provided.

As described above with reference to the embodiment and Examples, the sliding member according to the present invention in which the first sliding surfaces have DLC and the second sliding surface has a material having a frictional coefficient higher than that of DLC at a temperature of 25° C. and a humidity of 45%, removal of DLC from the substrate is controllable. The sliding member of the present invention may be used as an oilless sliding member without using oil and grease.

Although details are unknown, if the humidity is lower than 45% at a temperature of 25° C., the frictional coefficient of the material included in the second sliding surface can be lower than that of DLC. It is considered that, the humidity on the sliding surface becomes lower as the sliding time becomes longer, and the frictional coefficient of DLC becomes higher when the humidity becomes lower, but in the present invention, the member included in the second sliding surface lowers the frictional coefficient to compensate for the increase in the frictional coefficient of DLC. As a result, a desirable low friction sliding member may be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-039401, filed Feb. 27, 2015 which is hereby incorporated by reference herein in its entirety.

What is claimed is:

1. A sliding member provided with a sliding surface, wherein the sliding surface has a first sliding surface and a second sliding surface, the first sliding surface comprises diamond like carbon, the second sliding surface comprises a material of which frictional coefficient is higher than that of the diamond like carbon at a temperature of 25° C. and a humidity of 45%, and the frictional coefficient of the sliding member is 0.12 or less, wherein the sliding member includes a plurality of first sliding surfaces mutually separated, and the second sliding surface is disposed in a region between the mutually separated first sliding surfaces.

2. The sliding member according to claim 1, wherein the sliding member is cylindrical in shape and the sliding surface is a cylindrical surface.

3. The sliding member according to claim 1, wherein the sliding member is cylindrical in shape and the sliding surface is an inner side of the cylinder.

4. The sliding member according to claim 1, wherein the sliding member is sheet-shaped.

5. The sliding member according to claim 1, wherein the plurality of first sliding surfaces are arranged in at least one of a stripe pattern and a dot pattern.

6. The sliding member according to claim 5, wherein a pitch interval of the plurality of first sliding surfaces is equal to or greater than 1 μm to equal to or smaller than 1 mm.

7. The sliding member according to claim 1, wherein a frictional coefficient of the material of the second sliding surface is equal to or greater than 0.12 to equal to or lower than 0.30 at a temperature of 25° C. and a humidity of 45%.

8. The sliding member according to claim 7, wherein the material of the second sliding surface is at least one of $MoS_2$, $WS_2$, BN, POM, PE, and PPS.

9. The sliding member according to claim 8, wherein the material of the second sliding surface is at least one of $MoS_2$ and $WS_2$.

10. The sliding member according to claim 1, wherein the sliding member is a member for sliding against the sliding counterpart disposed in contact with the sliding surface.

11. The sliding member according to claim 10, wherein the sliding causes the sliding member and the sliding counterpart disposed in contact with the sliding surface of the sliding member to at least one of relatively reciprocate and rotate.

12. The sliding member according to claim 10, wherein the sliding counterpart is one of SUS, SUJ2 and a nickel-plated member.

13. The sliding member according to claim 10, wherein the sliding member is an oilless sliding member without using oil and grease.

14. The sliding member according to claim 10, wherein the second sliding surface is disposed on a substrate in a region where the first sliding surface is not disposed.

15. A sliding device comprising:

the sliding member according to claim 1;

a sliding counterpart disposed in contact with the sliding surface of the sliding member; and a driving unit configured to drive at least one of the sliding member and the sliding counterpart disposed in contact with the sliding surface of the sliding member.

16. The sliding device according to claim 15, wherein the driving causes the sliding member and the sliding counterpart disposed in contact with the sliding surface of the sliding member to at least one of relatively reciprocate and rotate.

17. The sliding device according to claim 15, wherein the sliding counterpart is one of SUS, SUJ2 and a nickel-plated member.

18. An electrophotographic image forming apparatus, wherein the sliding device according to claim 15 is provided in a conveyance unit configured to convey a recording medium on which an image is to be recorded.

19. An apparatus comprising: the sliding device according to claim 15; and a conveying mechanism configured to convey an article upon rotation of the shaft of the sliding mechanism.

* * * * *